US007735400B2

(12) United States Patent
Chen

(10) Patent No.: US 7,735,400 B2
(45) **Date of Patent: *Jun. 15, 2010**

(54) TORQUE RELEASING CLUTCH FOR A SCREW DRIVER BLADE

(76) Inventor: Ho-Tien Chen, No. 50-1, Lane 60, Chen-Ping 9 St, Tainan City (TW)

( * ) Notice: Subject to any disclaimer, the term of this patent is extended or adjusted under 35 U.S.C. 154(b) by 170 days.

This patent is subject to a terminal disclaimer.

(21) Appl. No.: 11/841,525

(22) Filed: Aug. 20, 2007

(65) Prior Publication Data

US 2009/0049961 A1 Feb. 26, 2009

(51) Int. Cl.
*B25B 23/143* (2006.01)
*B25B 15/00* (2006.01)

(52) U.S. Cl. ..... 81/429; 81/467

(58) Field of Classification Search ..... 81/429, 81/467; 279/22, 75

See application file for complete search history.

(56) References Cited

U.S. PATENT DOCUMENTS 3,793,912 A * 2/1974 Bilz ..... 81/53.2
3,937,036 A * 2/1976 Sauerwein ..... 464/36
4,284,923 A 8/1981 Pottier ..... 315/5.51
4,653,358 A * 3/1987 Lankry ..... 81/474
4,753,142 A 6/1988 Horniing ..... 81/429
5,182,973 A * 2/1993 Martindell ..... 81/429
5,350,026 A * 9/1994 Markus et al. ..... 173/178
5,437,524 A * 8/1995 Huang ..... 408/139
5,576,501 A * 11/1996 Huang ..... 73/862.23
5,996,452 A * 12/1999 Chiang ..... 81/429
6,192,776 B1 * 2/2001 Leitner ..... 81/429
6,364,318 B1 * 4/2002 Bedi et al. ..... 279/22
6,530,299 B1 * 3/2003 Liu ..... 81/451
7,175,185 B2 * 2/2007 Chen ..... 279/75
7,278,640 B2 * 10/2007 Allan et al. ..... 279/79
7,383,756 B1 * 6/2008 Liu ..... 81/467
7,387,054 B2 * 6/2008 Rajotte ..... 81/429

FOREIGN PATENT DOCUMENTS

TW M247354 10/2004

* cited by examiner

*Primary Examiner*—David B Thomas
(74) *Attorney, Agent, or Firm*—J.C. Patents

(57) ABSTRACT

A torque releasing clutch for a screw driver blade is installed in a connect rod, including a spring, ball holes for fitting steel balls, and a washer respectively in the holes to restrict the spring and the steel balls within the groove of the clutch so that the clutch moves forward and backward regularly. When a screw is driven in an object for a preset depth, the clutch may push forward the screw driver blade so that the torque-releasing steel balls may release the screw driver blade in time. Then, even if the screw driver should still have some torque, it might only rotate the connect rod idly, keeping the driver blade immovable. Thus the remaining torque might not damage the blade slot of the screw, in addition to avoiding the remaining torque returning to a user of the screw driver and harming the user.

15 Claims, 12 Drawing Sheets

TORQUE RELEASING CLUTCH FOR A SCREW DRIVER BLADE

BACKGROUND OF THE INVENTION

1. Field of the Invention

This invention relates to a torque releasing clutch for a screw driver blade, particularly to one installed in a connect rod to be combined with a screw driver, permitting torque releasing steel balls to timely release the screw driver blade so that the connect rod may rotate idle not to turn the screw driver blade even if the screw driver still have some torque remained. In this way, the remaining torque of a screw driver may not harm and shock the blade slot of a screw, in addition to avoiding feeding back of the remaining torque to a user of the screw driver to cause harm to the user.

2. Description of the Prior Art

A known screw driver blade holder disclosed in a U.S. Pat. Nos. 4,284,923 and 4,753,142 includes a connect rod 1, and a combining rod 10 for connecting with an electric tool or a manual tool, and an E-shaped groove 11 for an E-shaped locking washer 110 to fit therein, and a fitting edge 12 for reversing rotation, an inner ring 15 and an outer ring 16 for the screw driver blade to be kept in an extended condition as shown in FIG. 3, for screwing off a screw deeply driven in an object. Further, the screw driver blade holder is provided with plural torque releasing ball holes 13 for releasing steel balls 130 fitted therein, and a combining groove 14 and an elastic locking ring groove 140 formed in an inner wall of the combining groove 14 for fitting an elastic locking ring 141 therein to fit in an annular recess 170 of the screw driver blade 17. The outer sleeve 15 has a central through hole 150 for the connect rod 1 to fit in, and a spring 151 fitted around the connect rod 1. Further an inner sleeve 16 is provided, to fit in the outer sleeve 15, with its inner end pushing one end of the spring 151 and having an annular recess 160 for the releasing steel balls 130 to fit in so as to timely releasing the driving torque of the screw driver blade.

When a screw is driven in an object with the screw driver blade in the condition shown in FIG. 1, the driver blade cannot be adjusted in its extended length to suit to the depth of the screws to be driven in an object. So the conventional screw driver blade cannot suit to various depths of screws to be driven in objects, and a screw such as a square screw has to leave a comparative long head on an object, hardly able to be driven with a good effect. Moreover, the driver blade 17 is fixed in the connect hole 14 of the connect rod 1 by means of the elastic locking ring 141, but the driver blade 17 is difficult to be taken off, needing a spanner to cause inconvenience.

Next, FIGS. 44 and 5 show a second conventional screw driver blade holder disclosed in a Taiwan patent No, M247354, which is provided with a spring 80 in a connect rod 8 for pushing a screw driver blade 81 forward, but the blade hole 82 for the driver blade is shaped hexagonal the same as the driver blade, having driving force, but no function of clutching action for releasing torque of the tool.

The first and the second conventional clutch for a screw driver blade have the common flaw that the screw driver blade is separated from the blade slot of a screw before the driver blade is not completely stopped turning after the screw is driven to a preset depth, with the hand of a user released from the switch of the tool. Then the driver blade has some remaining torque coming from the motor of the tool, continuing to turn to damage the blade slot of the screw and possibly hurting a user as well. Especially it happens often that a worker is working on a roof fixing metal plates, and for attempting to finish the work quickly, the worker may at once pull off an electric tool when a screw has been driven to a needed depth, preparing to move the body to a next location where another screw is to be fixed. At that time the worker may not stand in a most balanced condition as to fall down from the roof by the remaining torque of the electric tool.

SUMMARY OF THE INVENTION

One purpose of the invention is to offer a torque releasing clutch for a screw driver blade, which is provided with torque releasing steel balls for timely releasing a screw driver blade. Even if there remains some torque on the driver blade, it may not return to a user holding the tool, without endangering the user.

Another purpose of the invention is to offer a torque releasing clutch for a screw driver blade, which may let a connect rod to rotate idle, regardless of some torque still remaining in the tool, so the driver blade may not continue to turn to give damage to the blade slot of a screw driven.

One more purpose of the invention is to offer a torque releasing clutch for a screw driver blade, which is provided with tightening steel balls in the connect rod for securing a screw driver blade so that the screw driver blade is easily combined with or freed from the connect rod to be replaced with another, The invention has the following features.

1. The clutch is installed in a connect rod, with torque releasing steel balls timely releasing a screw driver blade, so even though the tool still has some torque remaining, it may not return to a user to give harm or continue to drive the screw already driven to the preset depth as to damage the blade slot of the screw.
2. The connect rod is provided with three steel balls spaced apart for 120 degrees in a central combining hole for timely releasing the driving torque of the screw driver blade, with mutual function of a outer sleeve and the steel balls.
3. The tightening steel balls provided in the connect rod can permit the screw driver blade quickly and easily combined with or taken off the connect rod with assistance of the outer sleeve.
4. The outer sleeve is provided with depth adjusting and tightening steel balls, and the depth adjusting member and the outer sleeve can be adjusted and secured in the relative position so the depth of a screw to be driven in an object can be adjusted, by an O-shaped ring forcing the tightening steel balls.
5. A front slide ring is fitted in the front end of the depth adjusting member and a C-shaped locking ring is deposited between the front slide ring and the depth adjusting member, permitting the front slide ring may be movable freely so that the outer surface of a screw being driven into an object may not be harmed by the front slide ring.
6. A front cylindrical sleeve is provided to fit in a front end of the connect rod, easily changeable to correspond to various screws.
7. The connect rod is provided with a projecting edge to correspond to an annular groove formed in the inner wall of the outer sleeve, permitting a screw driver blade to extend out for reversely turning out a screw set in an object.

BRIEF DESCRIPTION OF DRAWINGS

This invention will be better understood by referring to the accompanying drawings, wherein.

DETAILED DESCRIPTION OF THE PREFERRED EMBODIMENTS

Figure 9:
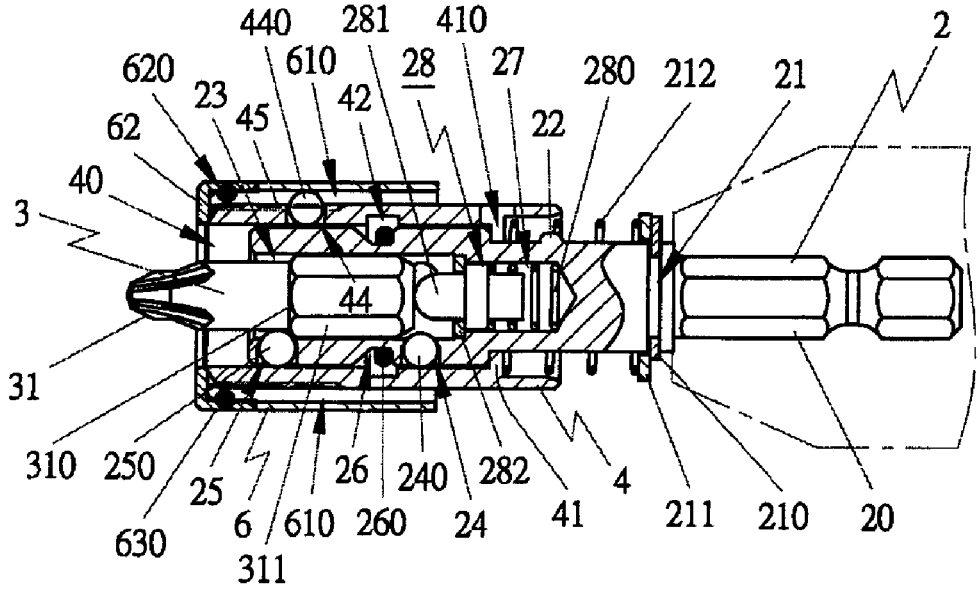
FIG. 9 is a cross-sectional view of the first preferred embodiment of a torque releasing clutch for screw driver blade in the present invention, showing the clutch releasing the torque.
Figure 10:
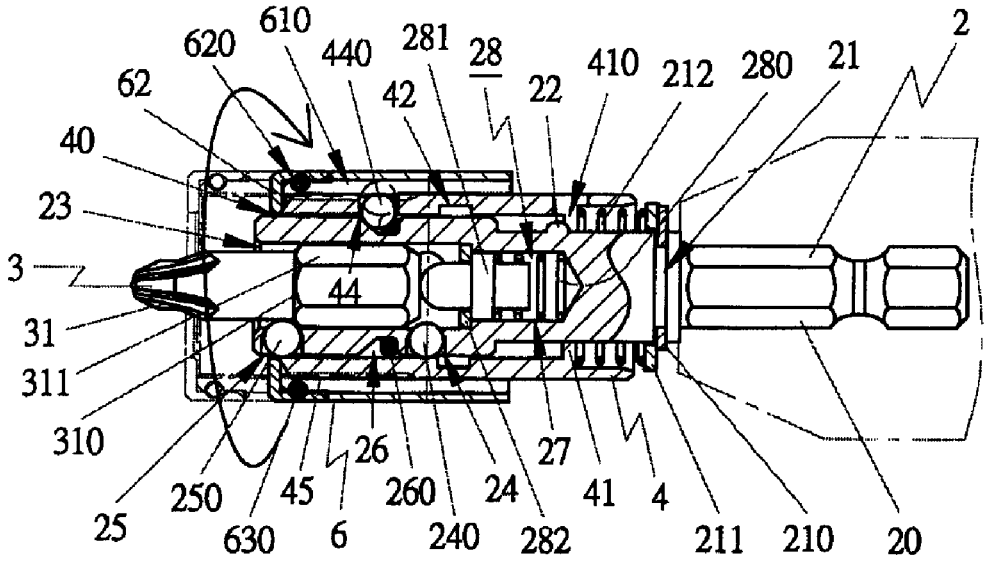
FIG. 10 is a cross-sectional view of the first preferred embodiment of a torque releasing clutch in the present invention, showing a screw driver blade being adjusted in its locking depth.

A first preferred embodiment of a torque releasing clutch for a screw driver blade in the present invention, as shown in FIGS. 6-14, includes a connect rod 2 provided with a combining rod 20 to connect with a conventional manual tool or a conventional electric tool, an E-shaped fitting groove 21 formed on the connect rod 2 for an E-shaped locking washer 210 to fit therein, a washer 211 and a spring 212 fitted around an intermediate portion of the connect rod 2 beside the E-shaped locking washer 210 for limiting a retreat distance of an outer sleeve 4. Further, the connect rod 2 is provided with a small projection 22 on a surface of the intermediate portion to enable the connect rod 2 to rotate reversely. Thus when the connect rod 2 is reversely rotated for loosening off a screw, the outer sleeve 4 is pushed rearward to let the screw driver blade extend out for a largest length and then the screw driver blade 3 can reversely be rotated to pull out the screw in an object. In addition, the connect rod 2 has a combining hole 23 in an inner end surface for the screw driver blade 3 to be inserted therein, and three steel-ball holes 24 formed spaced apart in 120 degrees in the intermediate portion for three steel balls 240 to fit therein, so that the screw driver blade 3 may be combined with the connect rod 2 as integral to rotate together. However, the steel balls 240 for releasing torque can be replaced by torque releasing pins 240A in a second preferred embodiment shown in FIG. 15. In addition, steel-ball holes 25 are formed spaced apart near the inner end for tightening steel balls 250 to be fitted therein for pressing the shank 311 of the screw driver blade 3 to keep stably the screw driver blade 3 in position in the center hole 23 of the connect rod body 2, as shown in FIGS. 9 and 10. If the screw driver blade 3 is to be replaced with another one, the outer sleeve 4 is pushed rearward, with the tightening steel balls 250 releasing the lower circumference of the screw driver blade 3. Then the screw driver blade 3 is quickly separated from the center hole 23, easily falling out by inverting the connect rod 2, unnecessary to use a pair of pliers as the conventional one needs. Further, the connect rod 2 has an annular recess 26 formed in the intermediate portion for an O-shaped ring 260 to fit in, and a clutch groove 27 formed in a deeper portion abutting the center hole 23 for positioning a clutch 28 therein, which is composed of a spring 280, a push member 281 at the front of the spring 280, and a gasket 282 fitting around the push member 281 to limit the spring 280 and the push member 281 within the clutch hole 27 for the clutch 28 to move back and forth in a constant distance.

Figure 11:
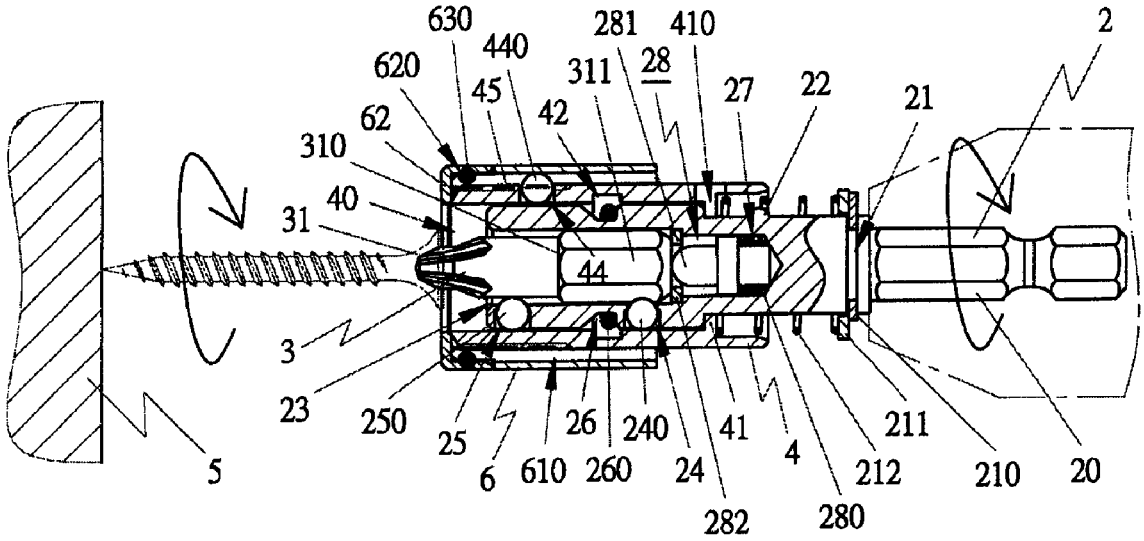
FIG. 11 is a cross-sectional view of a screw driver blade with the clutch of the first preferred embodiment in the present invention, showing the driver blade beginning to drive a screw in an object.
Figure 12:
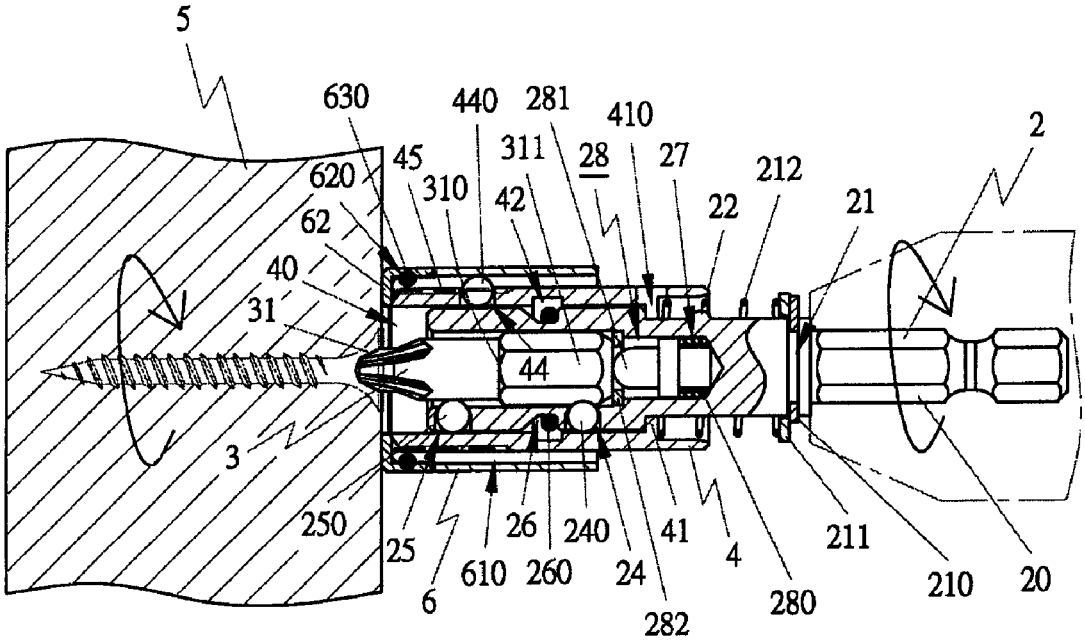
FIG. 12 is a cross-sectional view of the screw driver blade with the clutch of the first preferred embodiment in the present invention, showing the driver blade driving a screw to a certain depth in an object.
Figure 13:
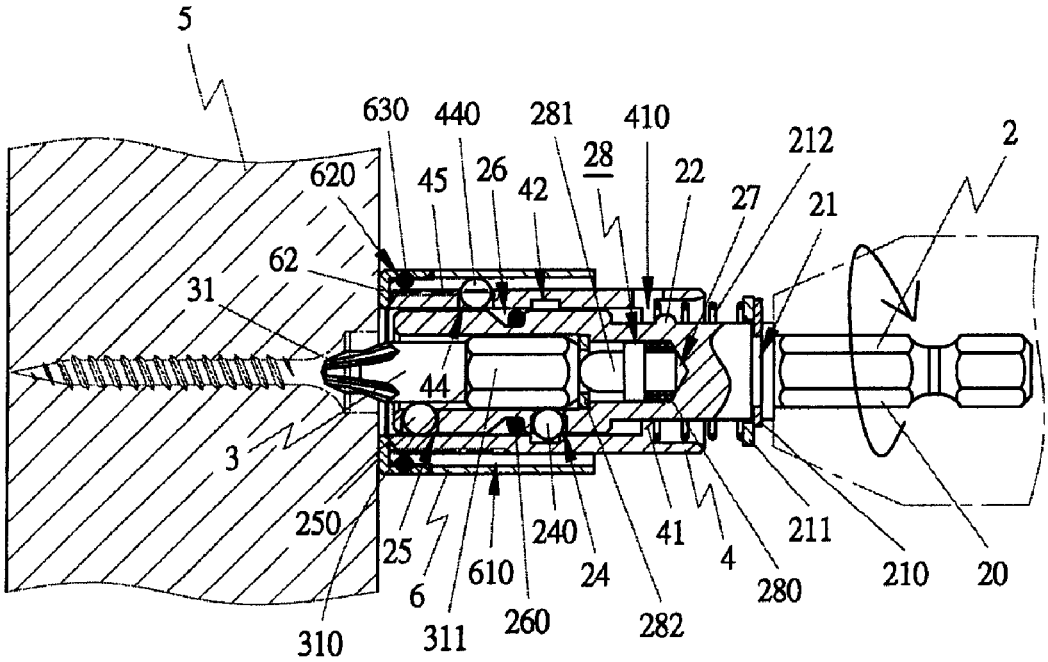
FIG. 13 is a cross-sectional view of the screw driver blade with the clutch of the first preferred embodiment in the present invention, showing the driver blade driving a screw to a preset depth in an object.
Figure 14:
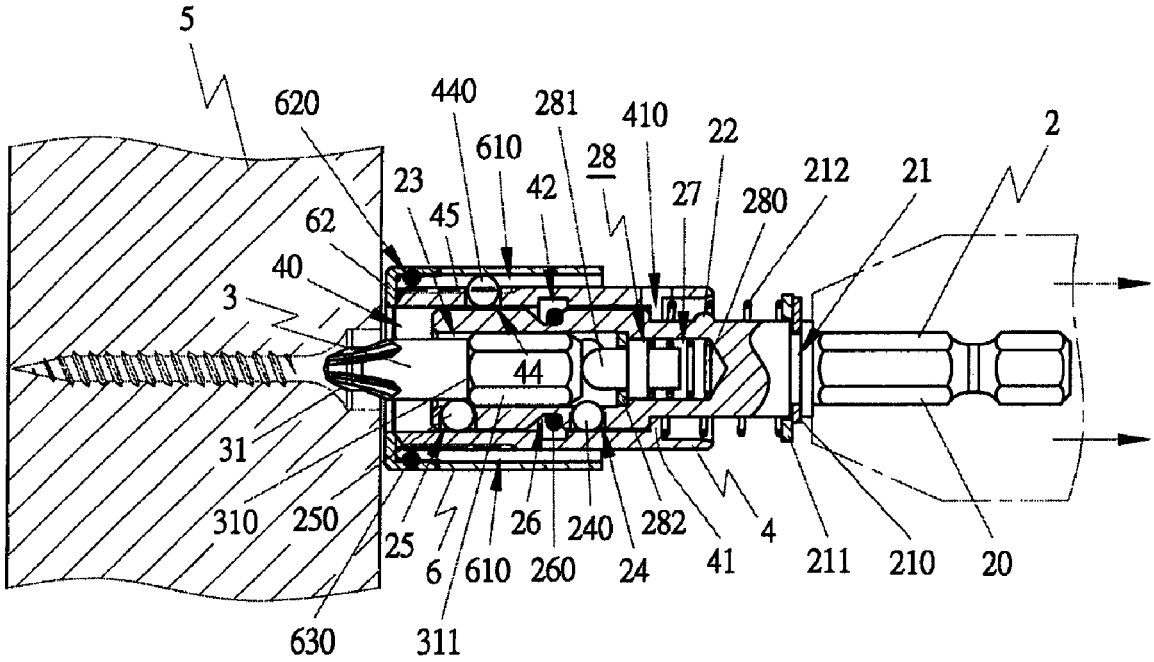
FIG. 14 is a cross-sectional view of the screw driven to the preset depth in the object, and in a torque released condition by retreating the screw driver by a user in the present invention.
Figure 15:
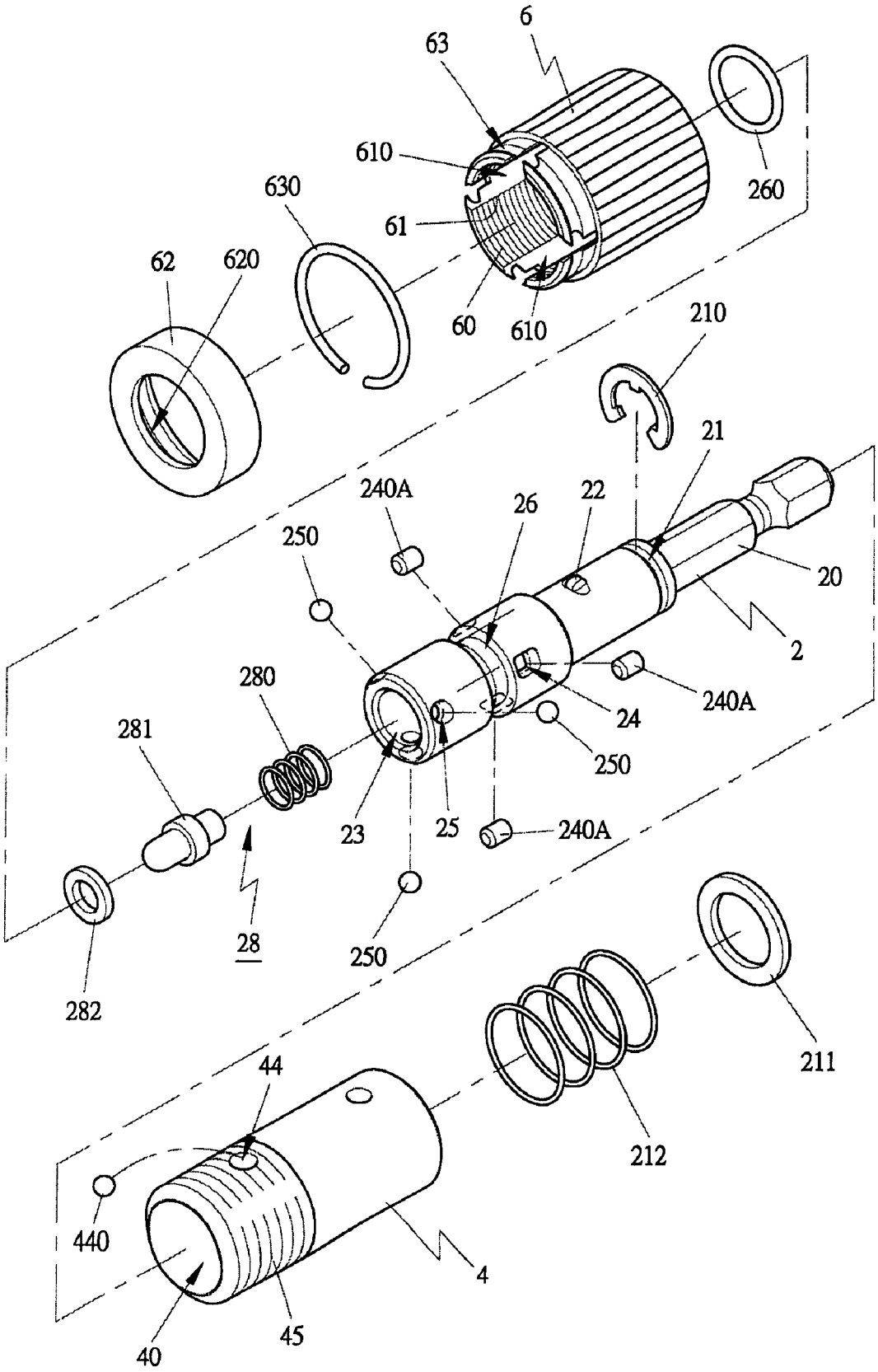
FIG. 15 is a partial exploded perspective view of a second preferred embodiment of a torque releasing clutch for a screw driver blade in the present invention.

In using, as shown in FIG. 11, when a screw is begun to drive in an object by a screw driver with the torque releasing clutch, the steel ball 240*s* press tightly the shank 311 of the screw driver blade 3, and a user continues to drive the screw in the object 5 as shown in FIG. 12, with the steel balls 240 keeping on pressing tightly the shank 311. Next, as shown in FIG. 13, when the screw is driven to a preset depth, a user will habitually release the switch of the manual tool, but at this time, the manual tool still has some torque remaining. At the instant when the screw driver blade 3 separates from the blade slot of the screw, as shown in FIG. 14, the clutch 28 may push forward the screw driver blade 3 so the steel balls 240 timely releases the screw driver blade 3. At this time, even if the manual tool still has some torque remaining, the connect rod 2 only rotates idle, with the screw driver blade 3 kept immovable. Therefore, the remaining torque of the manual tool makes no harm to the blade slot of the screw, and in addition, it is more important that the remaining torque cannot return to the user of the manual tool to endanger the user.

Figure 1:
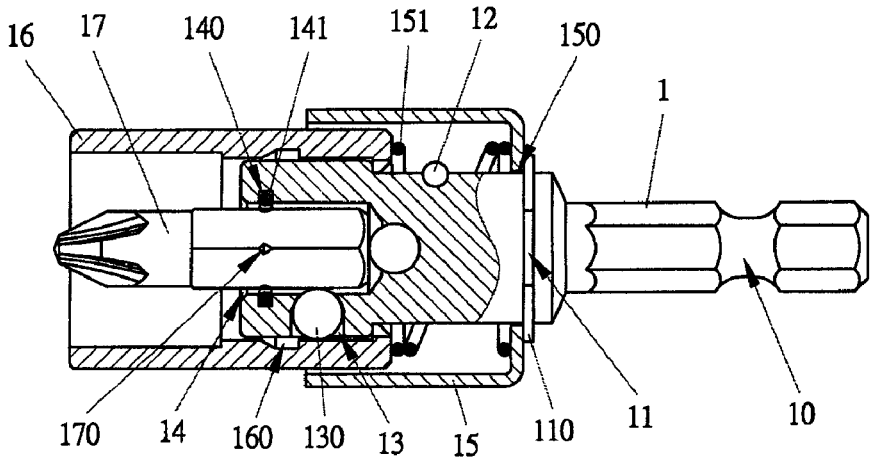
FIG 1 ( PRIOR ART )
FIG. 1 is a cross-sectional view of a conventional screw driver blade holder.
Figure 2:
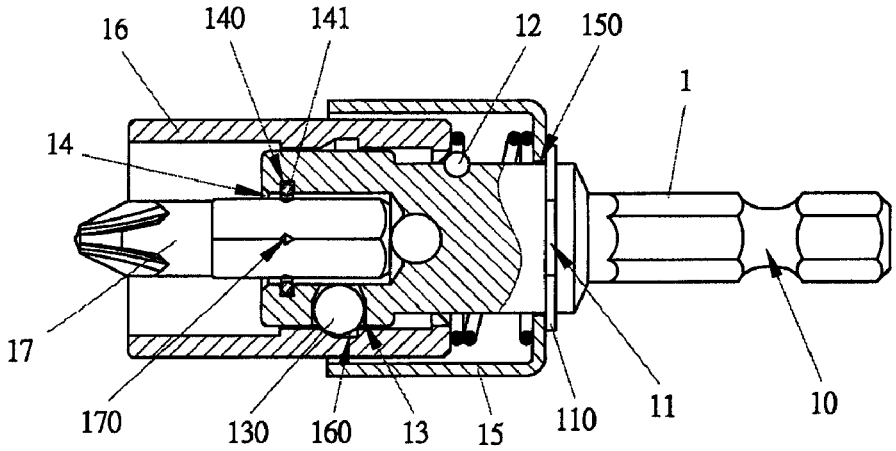
FIG 2 ( PRIOR ART )
FIG. 2 is a cross-sectional view of a screw driver blade being kept tightly in the conventional screw driver blade holder.
Figure 3:
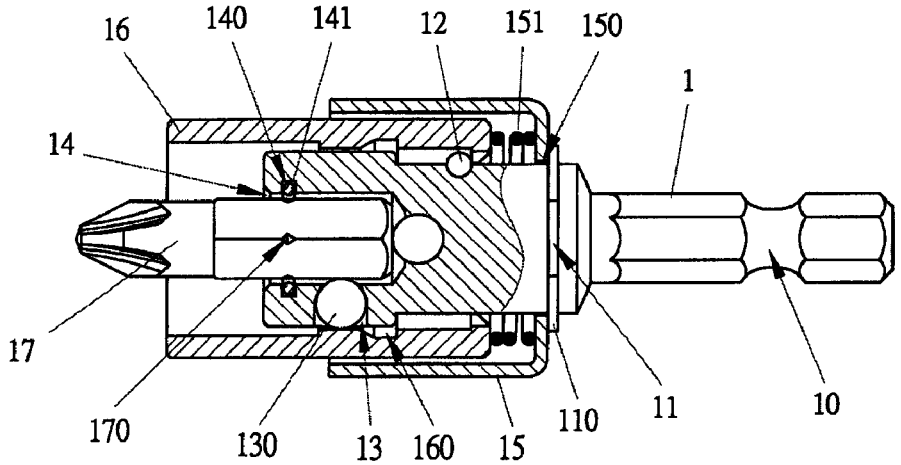
FIG 3 ( PRIOR ART )
FIG. 3 is a cross-sectional view of the screw driver blade being kept tightly by reverse turning in the conventional screw driver blase holder.
Figure 4:
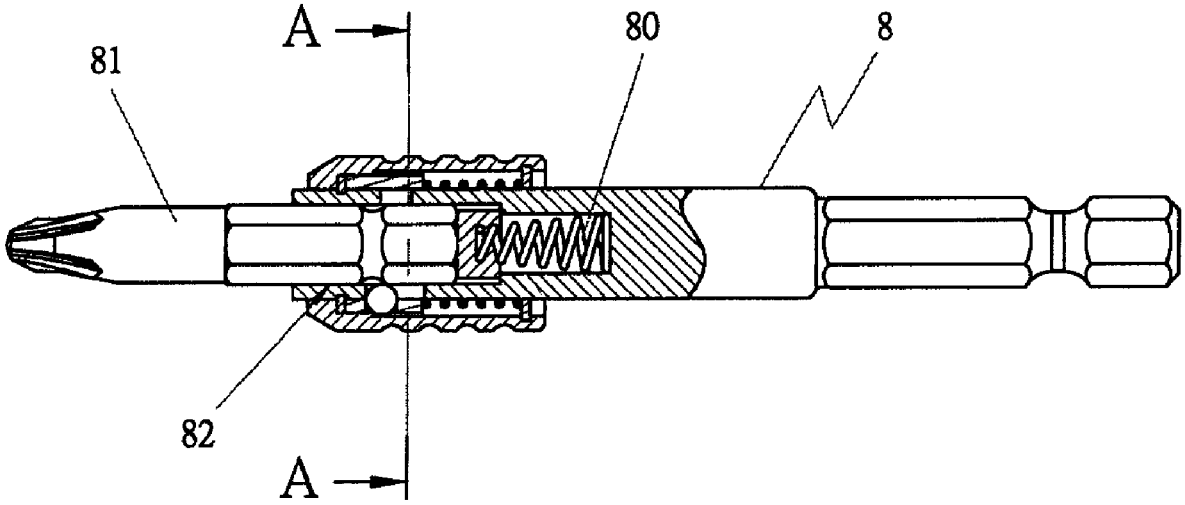
FIG 4 ( PRIOR ART )
FIG. 4 is a cross-sectional view of a second conventional screw driver blade holder.
Figure 5:
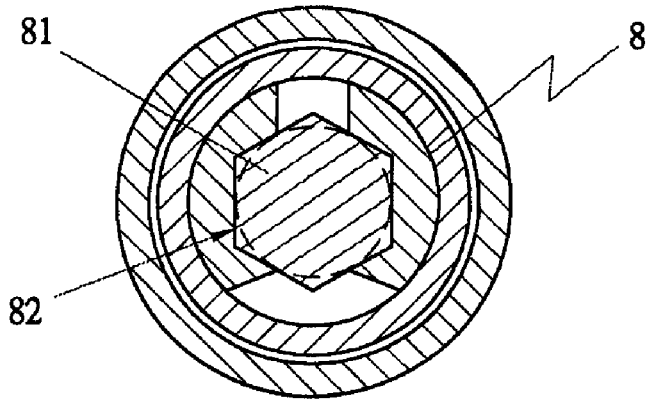
FIG 5 ( PRIOR ART )
FIG. 5 is a cross-sectional view of the line A-A in FIG. 4.
Figure 6:
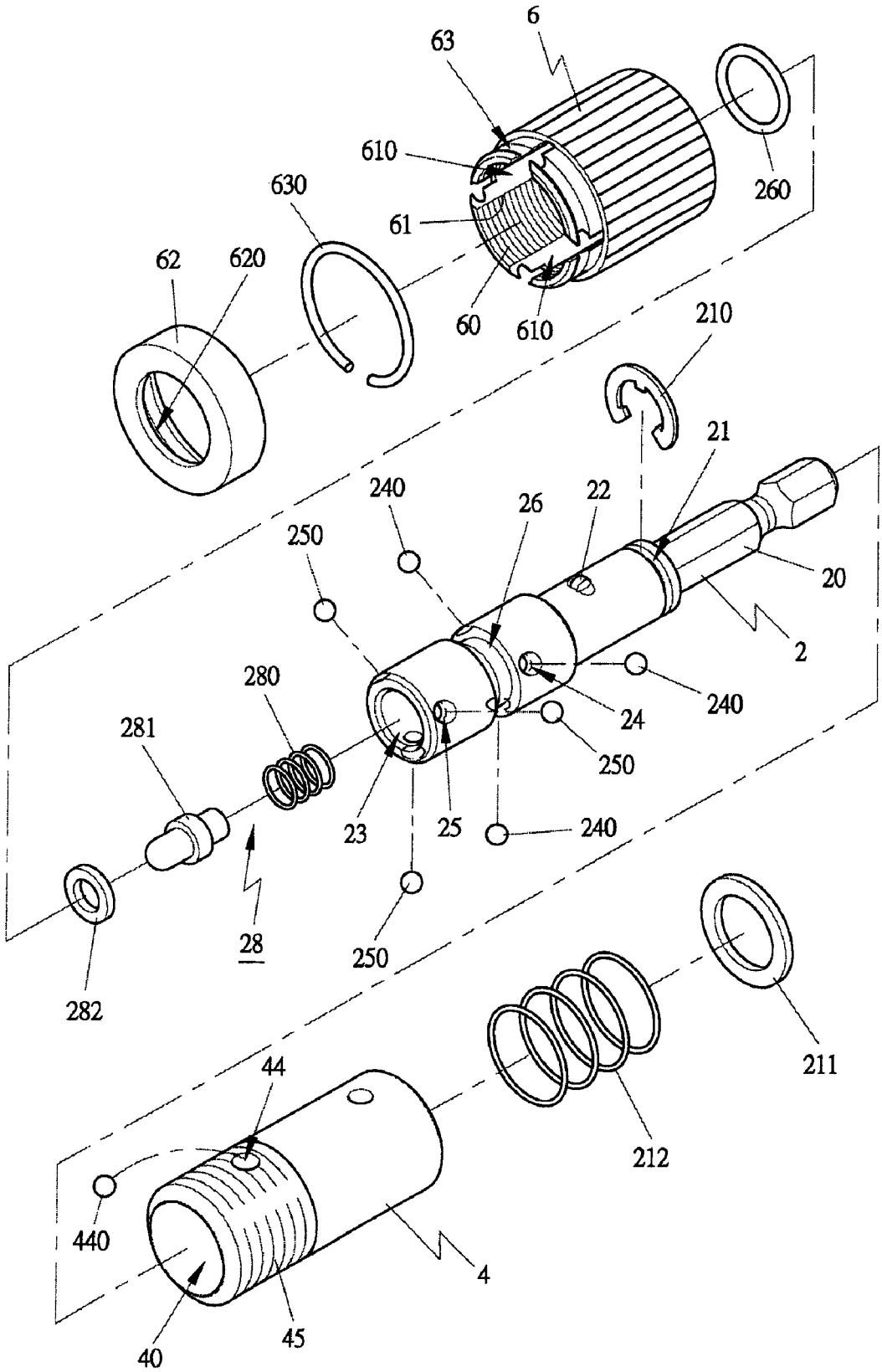
FIG. 6 is an exploded perspective view of a first preferred embodiment of a torque releasing clutch for a screw driver blade in the present invention.
Figure 7:
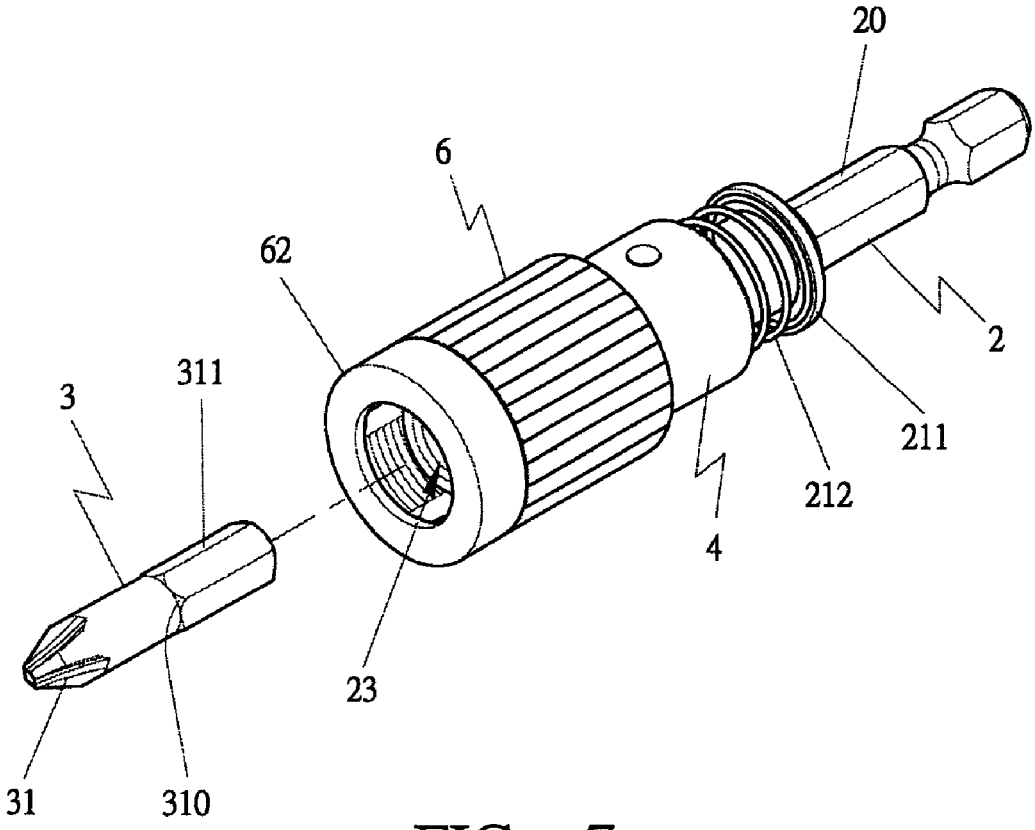
FIG. 7 is a partial exploded perspective view of the first preferred embodiment of a torque releasing clutch for a screw driver blade in the present invention.
Figure 8:
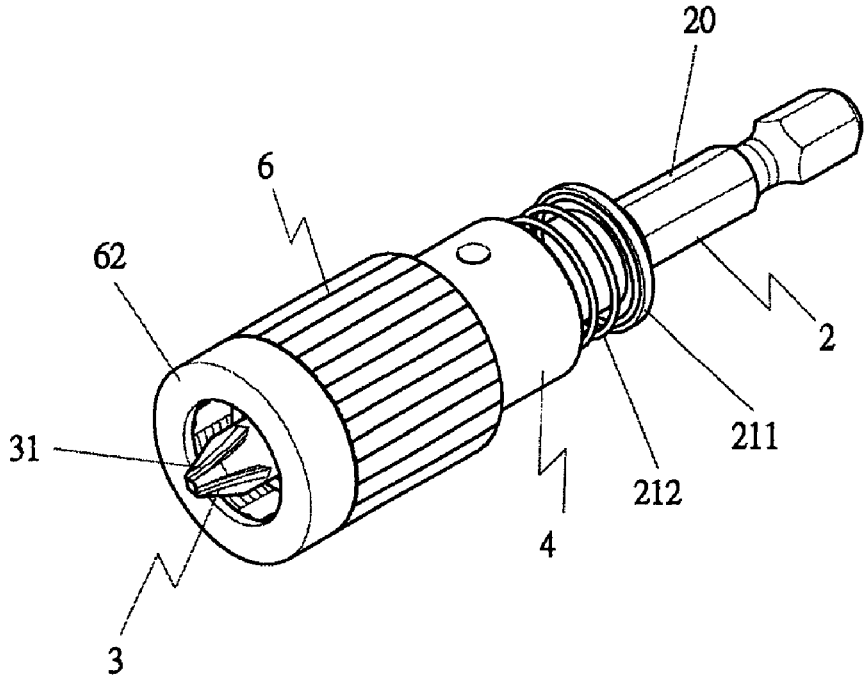
FIG. 8 is a perspective view of the clutch with the first preferred embodiment of a torque releasing clutch for a screw driver blade in the present invention.

The torque releasing clutch further includes an outer sleeve 4, and the outer sleeve 4 is provided with a through hole 40 as shown in FIG. 6 for receiving the connect rod 2 therein, an inner circumference 41 pressed by one end of the spring 212 of the connect rod 2, and a notch 410 formed in the inner circumference 41 to fit with the projection 22 of the connect rod 2. When the outer sleeve 4 is pulled back, letting the projection 22 moving via the notch 410 to another side of the inner circumference 41 as shown in FIG. 9, then the screw driver blade 3 is extended to the longest distance, fitting with the screw in an object 5. Then, the manual tool is rotated reversely to pull out the screw from the object 5. As only one notch 410 is formed in the inner circumference 41 in the first embodiment, if the screw drive blade 3 is turned for 360 degrees or so, the projection 22 moves back to the right side of the inner circumference 41, and the screw driver blade 3 is moved back to the original position. Further, the outer sleeve 4 is provided with an annular recess 42 as shown in FIG. 9 to fit with the steel balls 240. When the screw driver blade 3 is driven to a preset depth, a front ring 62 of a depth adjusting member 6 threadably combined with the connect rod body 2 pushes an object 5 as shown in FIG. 13, so the outer sleeve 4 may move back to force the steel balls 240 move into the annular recess 42 and release the screw driver blade 3 as shown in FIG. 13. Then the screw driver blade 3 is immovable, with the connect rod 2 rotating idle. It means that the driving torque of the screw driver blade 3 is released when the screw is driven to the preset depth, so that the friction between the tip of the screw driver blade 3 and the blade slot of the screw may not happen, causing no problem of quick wear of the screw driver blade 3. Moreover, when a user finishes driving a screw and wants to move back the screw driver blade 3, the clutch 28 pinches tightly the screw driver blade 3 as shown in FIGS. 9 and 10, forcing the screw driver blade 3 to separate from the steel balls 240, freeing the screw driver blade 3 that becomes no longer rotatable, for avoiding rotating inertia of the tool, waiting for next round of work. The outer sleeve 4 is further provided with an outer male threaded section 45 to engage with the depth adjusting member 6, and the outer male threaded section 45 has steel-ball holes 44 for receiving the steel balls 240. In order to adjust the engaging condition of the depth adjusting member 6 with the outer sleeve 4 for altering the distance between the outer sleeve 4 and the depth adjusting nut 6, it is enough to compress the outer sleeve 4 together with the depth adjusting member 6, forcing the steel balls 440 to push the O-shaped ring 260 as shown in FIG. 10. The O-shaped ring 260 functions as elastic buffer means, not only adjusting and positioning the depth adjusting member 6 and the outer sleeve 4, but also preventing the steel balls 440 from being dead stuck, which may cause a problem of difficult adjustment as shown in FIG. 9.

The depth adjusting member 6 is provided with inner female threads 60 to engage with the outer male threaded section 45 of the outer sleeve 4, and an elongate recess 610 in an inner wall 61. The elongate recess 610 can be single or plural, and in this embodiment, four recesses 610 are used, for matching with the operation of the steel balls 440. In case of adjusting the depth of a screw driven in an object, it is necessary at first to adjust the extended length of the screw driver blade 3. Then the combined position of the outer sleeve 4 with the depth adjusting member 6 has to be altered, as shown in FIGS. 9 and 10. So the outer sleeve 4 and the depth adjusting member 6 have to be pushed rearward, letting the steel balls 440 fall in the annular recess 26 as shown in FIG. 10, and the depth adjusting member 6 is to be turned for adjusting the driven depth of a screw. Then, the O-shaped ring 260 is forced by the steel balls 440, which can move in the annular recess 610 owing to the elastic buffer function of the O-shaped ring 260 and mutual operation of the annular recess 610 and the steel balls 440, sounding out pleasing rotation and producing proper positioning effect. In this way the driven depth of a screw is finished in its adjustment. After that, the outer sleeve 4 and the depth adjusting member 6 can move to their original position by rotating the outer sleeve 4 to let the inner notch 410 move to fit with the projecting edge 22 freeing the depth adjusting member 6 and the outer sleeve 4, with the steel balls 440 separating from the O-shaped ring 260 in the annular recess 26. Then the outer sleeve 4 together with the depth adjusting member 6 is pushed forward. Before a screw is driven to a preset depth, the screw driver blade 3 may continue to turn with the tool, so the depth adjusting member 6 may contact the surface of an object to harm it. In order to avoid the contact, a slide ring 62 is additionally combined with the front end of the depth adjusting member 6, with a C-shaped groove 63 formed in the front end of the depth adjusting member 6 for a C-shaped locking washer 630 to fit therein, and with a C-shaped groove 620 formed in the inner wall of the slide ring 62 to fit with the C-shaped locking washer 630. Then the slide ring 62 can rotate of itself, not rotated by the depth adjusting member 6. Therefore, the slide ring 62 does not rub against the surface of an object, preventing the object for a screw to be driven in from damaged.

Figure 16:
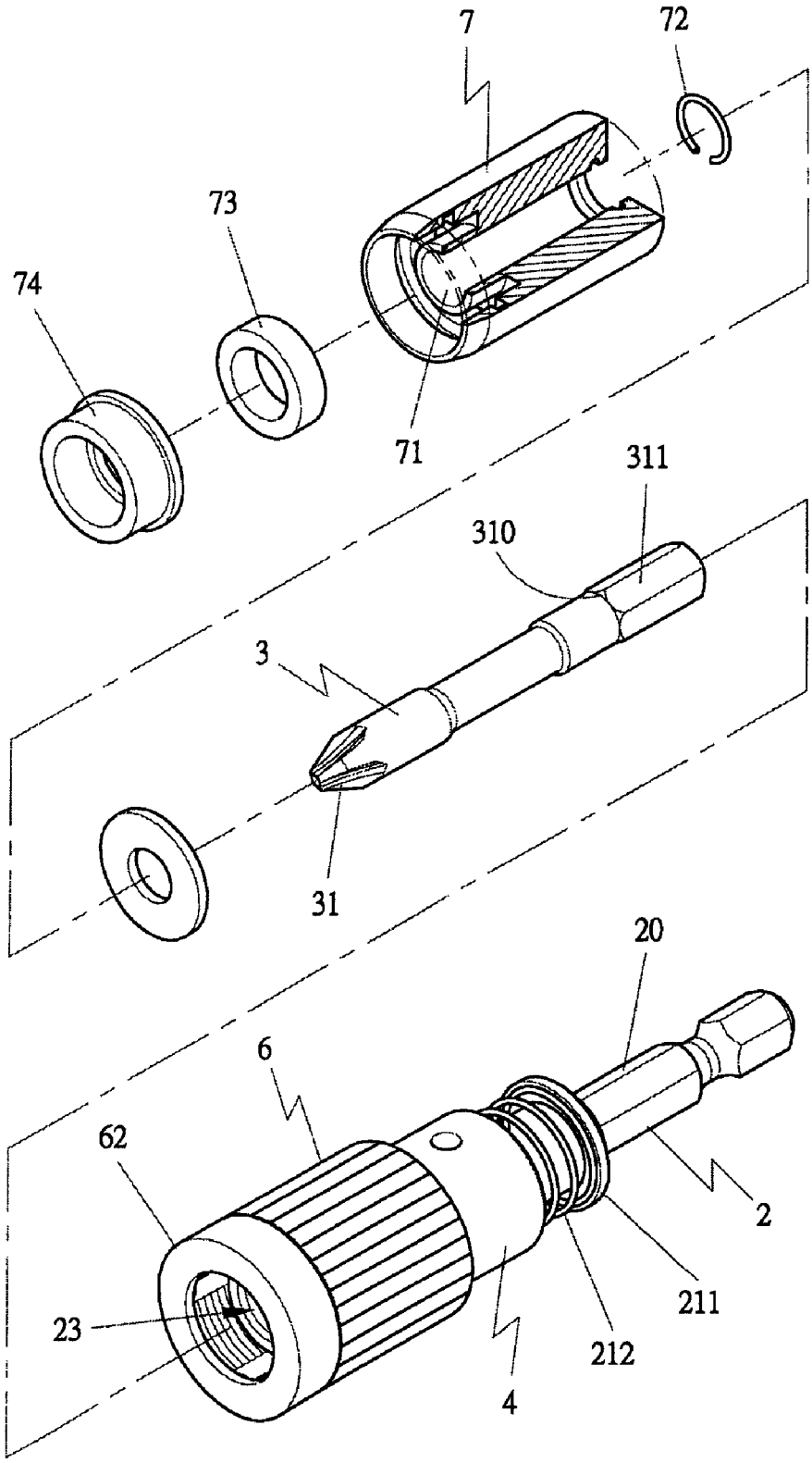
FIG. 16 is an exploded perspective view of a third preferred embodiment of a torque releasing clutch for a screw driver blade in the present invention.
Figure 17:
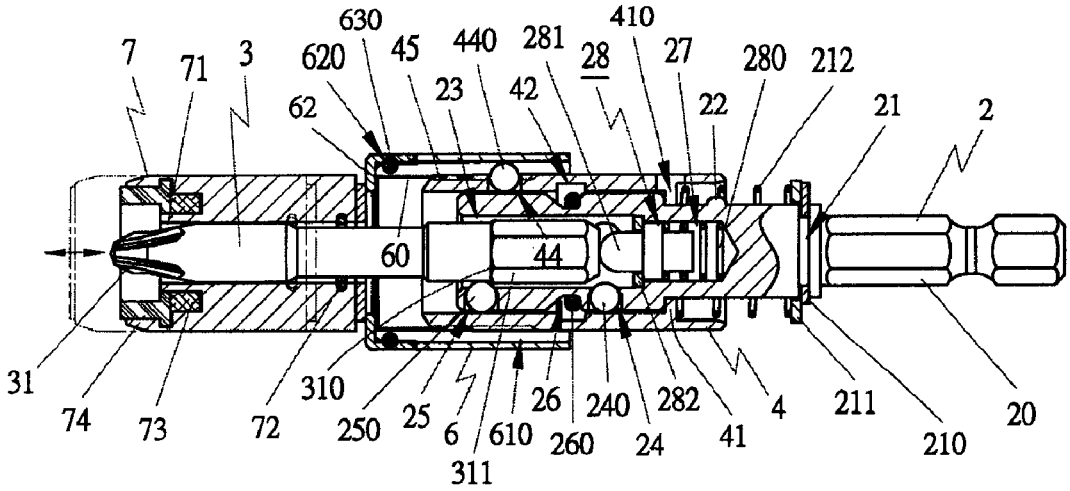
FIG. 17 is a cross-sectional view of the third preferred embodiment of a torque releasing clutch for a screw driver blade in the present invention.

Next, FIGS. 16 and 17 show a third embodiment of the clutch which includes a front cylindrical member 7 with a surface of high friction coefficient. Therefore, when the connect rod 2 rotates the front cylindrical member 7, and if the front cylindrical member 7 comes to contact with the surface of an object, the front cylindrical member 7 does not continue turning because of the friction of the front end of the front cylindrical member 7 against the surface of an object, so the object cannot be damaged. Further, a washer 70 is provided between the front cylindrical member 7 and the depth adjusting member 6, and a C-shaped locking washer 72 is fitted in a through hole 71 formed in the front cylindrical member 7. So when the screw driver blade 3 is combined with the front cylindrical member 7, the C-shaped locking washer 72 can restrict the inner end of the blade body 31 to keep the screw driver blade 3 from falling off. At the same time, the front cylindrical member 7 can move back and forth for making adjustment. Further, a magnetic ring 73 may be added in the front cylindrical member 7, and a front ring 74 is set before the magnetic ring 73 so as to let the front cylindrical member 7 easily attract a screw for driving a screw conveniently.

Figure 19:
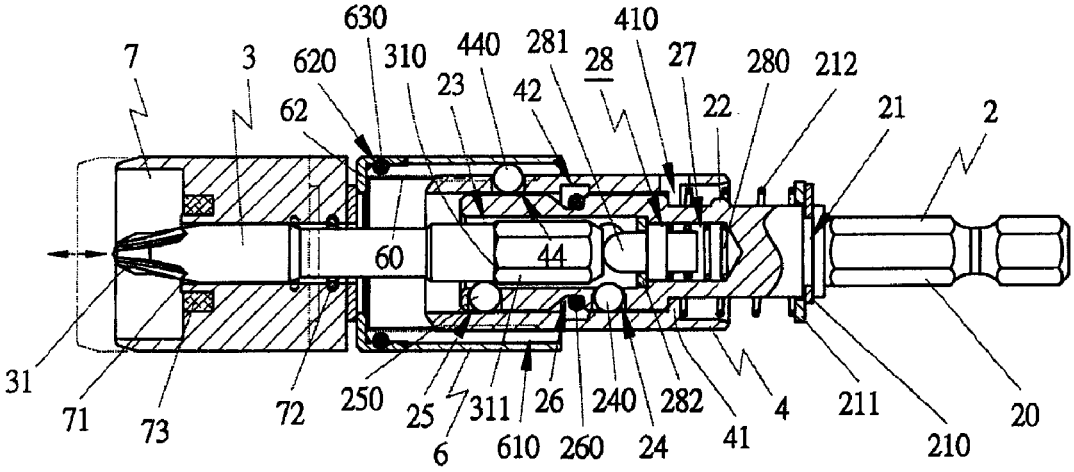
FIG. 19 is a cross-sectional view of the fourth preferred embodiment of a torque releasing clutch for a screw driver blade in the present invention.
Figure 18:
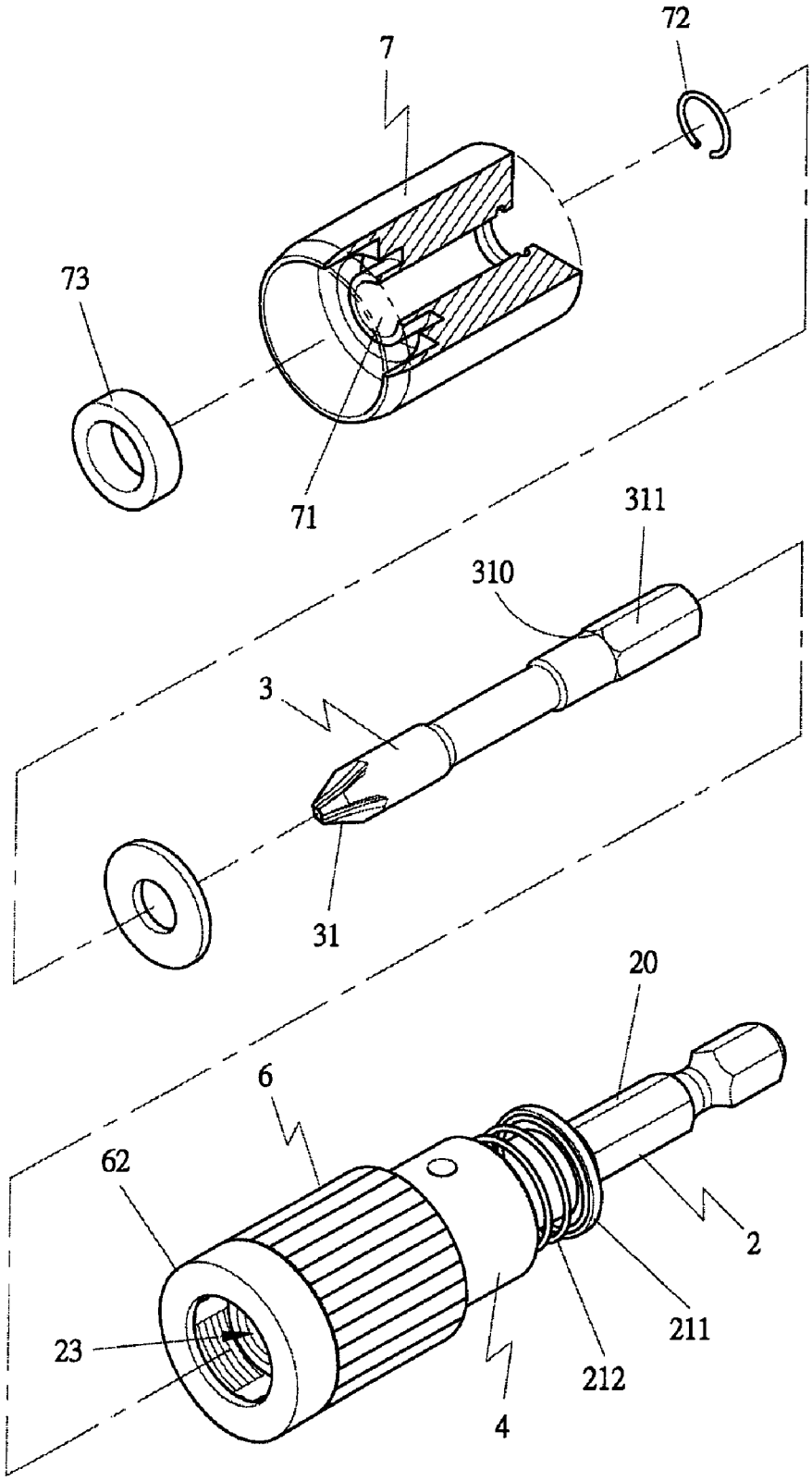
FIG. 18 is a partial exploded view of a fourth preferred embodiment of a torque releasing clutch for a screw driver blade in the present invention.

Next, FIGS. 18 and 19 show a fourth embodiment of the invention, which has almost the same structure of the third embodiment, but the front ring 74 in the third embodiment is omitted, with the magnetic ring 73 possible to directly attract a screw.

Figure 21:
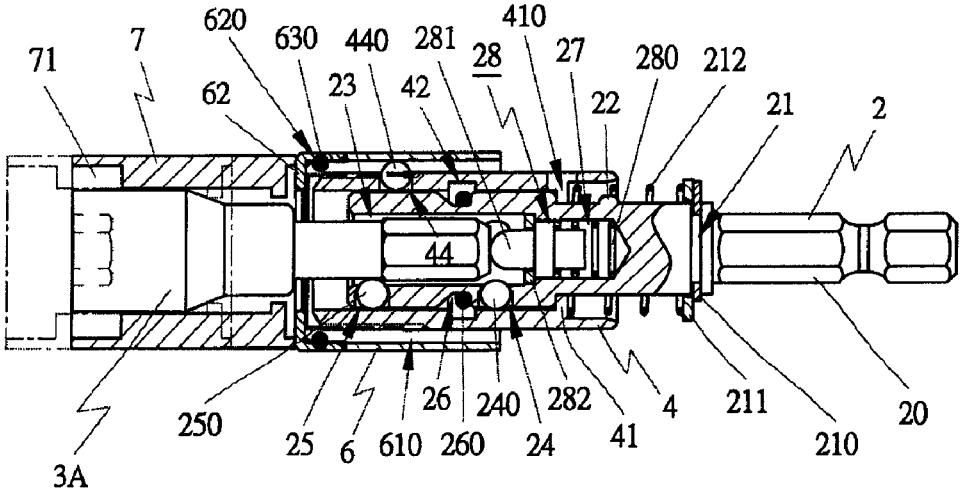
Figure 20:
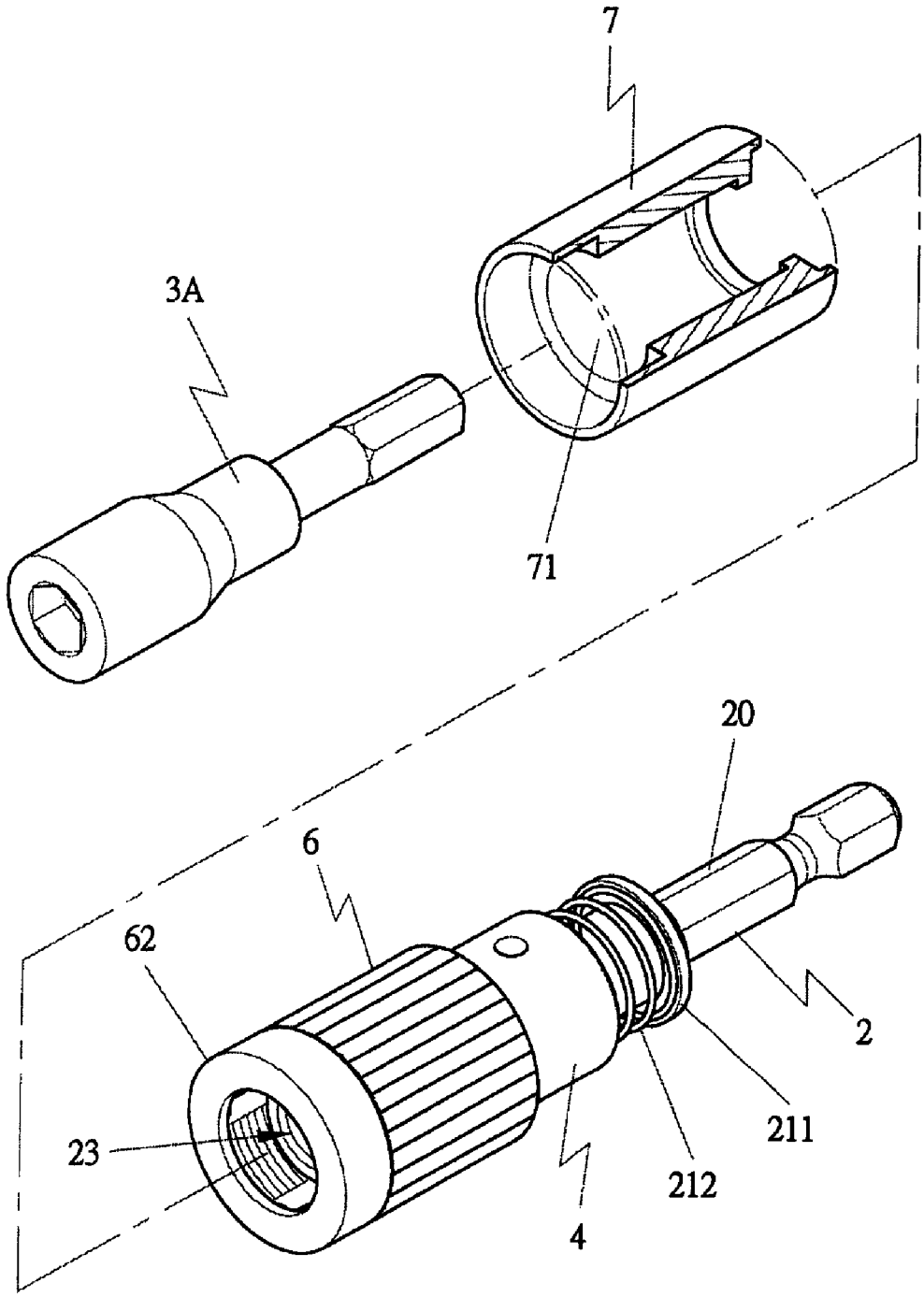
FIG. 20 is a partial exploded perspective view of the fourth preferred embodiment of a torque releasing clutch in the present invention; and, FIG. 21 is a cross-sectional view of a fifth preferred embodiment of a torque releasing clutch for a screw driver blade in the present invention.

Further, FIGS. 20 and 21 show a fifth embodiment of the invention, wherein the front cylindrical member 7 should have a through hole 71 of a large diameter to suit to a cylindrical screw driver blade 3A. The cylindrical screw driver blade 3A is first combined with the front cylindrical member 7 before the front cylindrical member 7 is combined with the connect rod 2, for being kept fixedly in position.

In general, the torque releasing clutch for a screw driver in the invention can be useful for any kind of screws, and can timely release the torque of the screw driver blade after a screw is finished driven in an object, upgrading the service life of a screw driver blade. Moreover, a user can be protected from harm and shock caused by remaining torque at the moment of finishing driving a screw, in addition to the minimized size of the torque releasing clutch.

While the preferred embodiments of the invention have been described above, it will be recognized and understood that various modifications may be made therein and the appended claims are intended to cover all such modifications that may fall within the spirit and scope of the invention.

What is claimed is:

1. A torque releasing clutch for a screw driver blade, said clutch comprising:

a connecting rod provided with a central combining hole for receiving a screw driver blade, a group of through holes for receiving torque-releasing balls, and an annular recess provided on an outer surface of said connecting rod;

an outer sleeve provided with a central through hole for receiving said connecting rod, an annular groove formed on an inner surface of said outer sleeve for receiving said torque-releasing balls, a male threaded section formed on an outer surface of said outer sleeve, and a through hole formed on the sidewall of said outer sleeve for receiving a depth adjusting ball; and a depth adjusting member provided with a central through hole for receiving said connecting rod, female threads formed on an inner wall of said central through hole of said depth adjusting member for engaging with said male threaded section of said outer sleeve, plural elongated grooves formed spaced apart on said inner wall along an axial direction of said central through hole of said depth adjusting member.

2. The torque releasing clutch for a screw driver blade as claimed in claim 1, wherein said connecting rod is provided with a projection on the outer surface thereof, and an annular projection with a notch is formed on the inner surface of the outer sleeve, the projection on the outer surface of the connecting rod coffesponds to the notch in the annular projection on the inner surface of the outer sleeve in size so that, when axially moving the outer sleeve relative to the connecting rod, the projection can only move across the annular projection through the notch.

3. The torque releasing clutch for a screw driver blade as claimed in claim 1, wherein said connect rod is provided with another group of through holes for receiving tightening balls, the tightening balls pinching tightly the screw driver blade.

4. The torque releasing clutch for a screw driver blade as claimed in claim 1 further comprising a front ring, wherein said depth adjusting member is provided with a C-shaped groove at its front end for a C-shaped locking washer to fit in, said front ring is also provided with a C-shaped groove in an inner wall of said front ring, said C-shaped washer fits in both said C-shaped groove of said front ring and said C-shaped groove of said depth adjusting member when said front ring is combined with said depth adjusting member, so that said front ring can rotate relative to said depth adjusting member.

5. The torque releasing clutch for a screw driver blade as claimed in claim 1, wherein said torque-releasing balls have a spherical shape or a cylindrical shape, and have a dimension comparable to that of the annular groove of the outer sleeve.

6. The torque releasing clutch for a screw driver blade as claimed in claim 1, wherein said through hole on the sidewall of said outer sleeve is formed in said male threaded section.

7. The torque releasing clutch for a screw driver blade as claimed in claim 1, wherein the dimension of the annular recess of the connecting rod, the dimension of the depth adjusting ball, and the dimension of the annular grooves of the depth adjusting member are determined such that, when assembled, relative rotary movement between the outer sleeve and the depth adjusting member is restricted by the depth adjusting ball when the depth adjusting ball is not located in the annular recess of the connecting rod.

8. A torque releasing clutch for a screw driver blade, said torque releasing clutch comprising:

a connecting rod provided with a central combining hole for a screw driver blade to be fitted in, plural holes for receiving torque releasing balls therein, and an annular recess;

an outer sleeve provided with a central through hole for said connect rod to fit therein, an annular groove for said torque-releasing balls to fit therein, a male threaded section on an outer surface of said outer sleeve, a depth-adjusting ball hole bored in said male threaded section for receiving an adjusting ball therein;

a depth adjusting member provided with female threads to engage with said male threaded section of said outer sleeve, plural elongate grooves in an inner wall of said depth adjusting member; and, a front cylindrical member having a central through hole and combined tightly with said screw driver blade.

9. The torque releasing clutch for a screw driver blade as claimed in claim 8, wherein a washer is provided between said front cylindrical member and said depth adjusting member.

10. The torque releasing clutch for a screw driver blade as claimed in claim 8, wherein a C-shaped locking washer is provided in said central through hole of the front cylindrical member, and said C-shaped locking washer restricts an inner end of said screw driver blade.

11. The torque releasing clutch for a screw driver blade as claimed in claim 8, wherein a magnetic ring is placed in said front cylindrical member.

12. The torque releasing clutch for a screw driver blade as claimed in claim 11, wherein a ring is put before said magnetic ring for keeping said magnetic ring at a definite location.

13. The torque releasing clutch for a screw driver blade as claimed in claim 8, wherein said central through hole of said front cylindrical member has a comparatively large diameter for a cylindrical screw driver blade to be fitted in.

14. The torque releasing clutch for a screw driver blade as claimed in claim 8, wherein said front cylindrical member is combined with a front end of said depth adjusting member, for convenience of driving various kinds of screws.

15. The torque releasing clutch for a screw driver blade as claimed in claim 8, wherein said front cylindrical member has a front surface configured to prevent the front cylindrical member from further rotating when the front surface comes into contact with a surface of an object being worked on because of the friction between the front surface and the surface of the object.

* * * * *